United States Patent [19]

Mikitka et al.

[11] Patent Number: 4,820,231

[45] Date of Patent: Apr. 11, 1989

[54] MANNEQUIN DEVICE

[75] Inventors: Nancy L. Mikitka, Orland Park; Emerson J. Purkapile; Duane R. Picht, both of Chicago, all of Ill.

[73] Assignee: Samaritan Industries, Inc., Orland Park, Ill.

[21] Appl. No.: 39,717

[22] Filed: Apr. 20, 1987

[51] Int. Cl.[4] ..... A63H 33/00; G09F 19/08

[52] U.S. Cl. ..... 446/73; 446/75; 446/268; 446/487; 206/216; 40/411; 40/610; 428/16

[58] Field of Search ..... 446/73, 74, 321, 327, 446/369, 487, 75; 190/1, 8; 206/216; 223/66, 68; 383/4; 428/16; 434/265, 266, 267; 40/214, 411, 538, 610

[56] References Cited

U.S. PATENT DOCUMENTS

| | | | |
|---|---|---|---|
| 2,655,762 | 10/1953 | Burke | 446/327 |
| 2,698,496 | 1/1955 | Miller | 223/67 X |
| 3,010,223 | 11/1961 | Alderson | 434/267 |
| 3,028,058 | 4/1962 | Wolf | 223/68 |
| 3,478,941 | 11/1969 | Dayton et al. | 223/67 |
| 3,801,403 | 4/1974 | Lucek | 446/220 X |
| 3,890,723 | 6/1975 | Haurat et al. | 434/267 |
| 4,204,361 | 5/1980 | Chaput | 446/74 |
| 4,413,442 | 11/1983 | McSweeney | 446/369 X |
| 4,563,159 | 1/1986 | Hills et al. | 446/369 X |
| 4,581,904 | 4/1986 | Lehmann et al. | 446/73 X |
| 4,601,670 | 7/1986 | Williams | 446/327 |
| 4,666,042 | 5/1987 | Dlott et al. | 446/73 X |
| 4,695,264 | 9/1987 | McLeod | 446/369 X |

FOREIGN PATENT DOCUMENTS

| | | | |
|---|---|---|---|
| 37196 | 3/1965 | Fed. Rep. of Germany | 446/74 |
| 7633 | 2/1906 | United Kingdom | 446/75 |

*Primary Examiner*—Robert A. Hafer
*Assistant Examiner*—Charles H. Harris
*Attorney, Agent, or Firm*—Allegretti & Witcoff, Ltd.

[57] ABSTRACT

A portable mannequin includes a carrying case which may be unfolded to reveal the contents which include a collapsible mannequin form having a head form and a torso form that are foldable in the case and unfoldable to fit upon the case in an erect fashion. The mannequin may be used as a security companion or by itself in automobiles, homes and the like.

17 Claims, 6 Drawing Sheets

Fig. 1
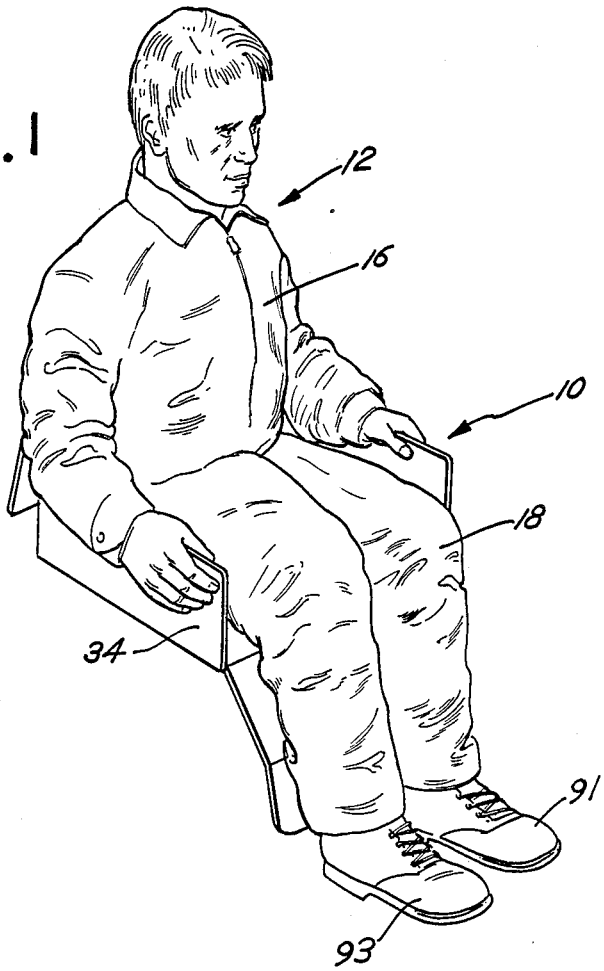
Fig. 2
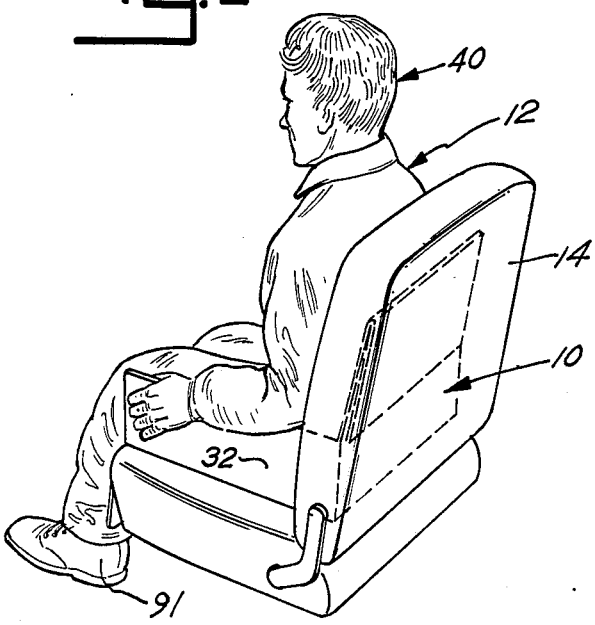
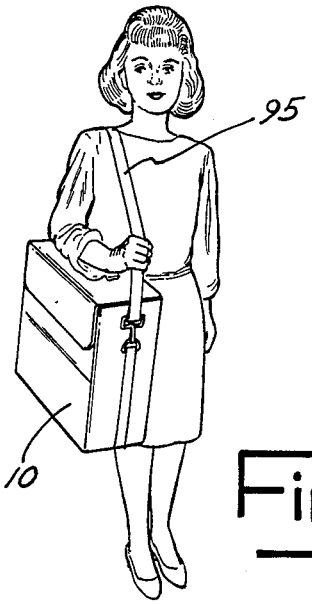
Fig. 3

Fig. 12
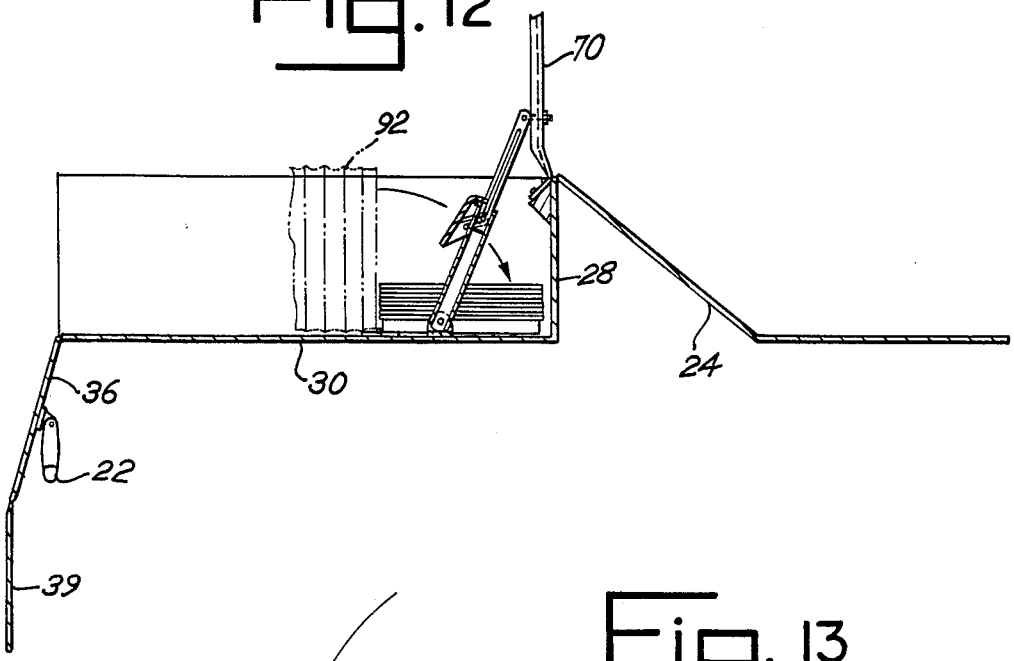
Fig. 13
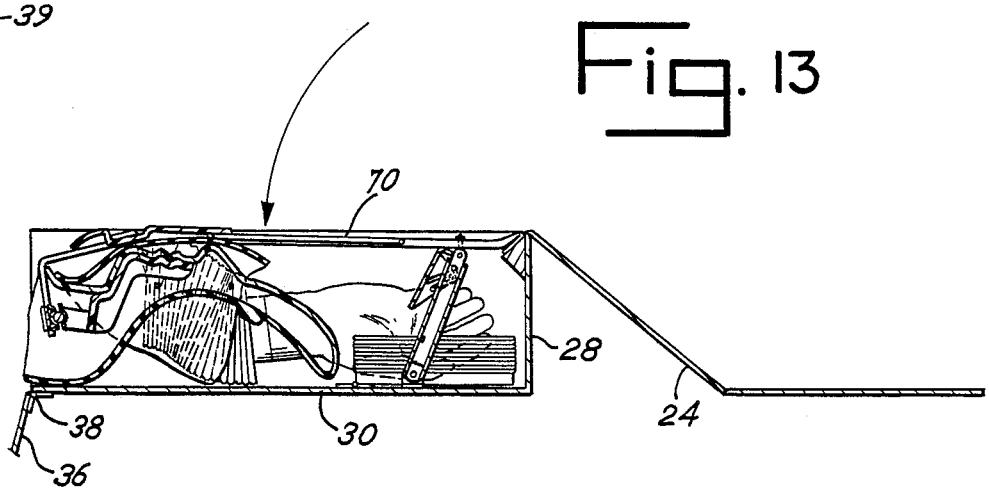
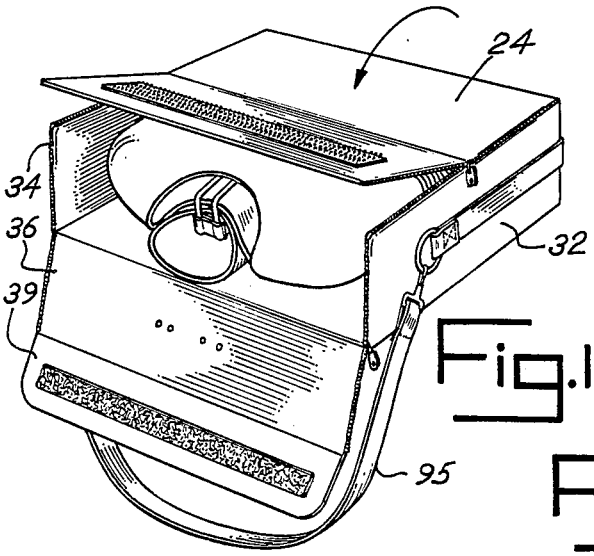
Fig. 14
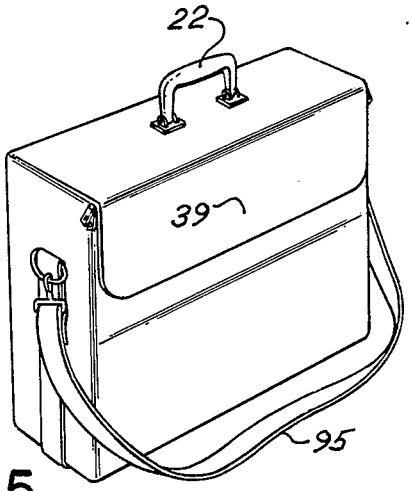
Fig. 15

MANNEQUIN DEVICE

BACKGROUND OF THE INVENTION

This invention relates to an improved portable mannequin and more particularly to a mannequin maintained in a carrying case or bag and which is erectable for use as a security device.

Traveling alone in an automobile or residing alone may subject an individual to potential assault, attack or intrusion. A single person without a companion often appears to be easy prey for assault or other criminal activity.

To diminish such a threat it has been suggested that a model or mannequin be utilized which would appear to be a companion of the potentially threatened individual. The concept of using a mannequin or decoy as an apparent companion is, itself, not new. The design, construction and configuration of such a mannequin is, however, not clearly taught in the prior art.

The prior art, for example, merely discloses various types of mannequins which may be easily assembled. Lucek U.S. Pat. No. 3,801,403 discloses a method for making an inflatable shaped mannequin form. Dayton Pat. No. 3,478,941 discloses an inflatable garment form incorporated in a package or container. Dayton teaches that the container also may include a source of gas or other inflation material which is used to fill a balloon-type mannequin form. A similar mannequin construction is disclosed by Wolf Pat. No. 3,028,058. Other inflatable or portable mannequins are disclosed by Miller Pat. No. 2,698,496, Haurate Pat. No. 3,890,723 and Alderson Pat. No. 3,010,223.

None of these prior art references appears to teach the concept of a portable mannequin to be used as a security device or security companion. Further, none of these prior art patents discloses a way to provide a portable mannequin which is easily assembled and may be used as a security companion or as an apparent sole occupant in a home, automobile or other environment.

SUMMARY OF THE INVENTION

In a principal aspect, the present invention comprises a portable mannequin including a collapsible mannequin form made up of a torso with an attached head and other appendages. The collapsible mannequin form cooperates with and may be maintained in a carrying case. Thus, the mannequin is collapsed or mechanically folded and maintained within the enclosure of the carrying case. In a preferred embodiment, the panels which form the case are pivotally connected and when the enclosure, which retains the mannequin, is opened, the mannequin may be erected and placed on a chair, bench or seat so as to appear as a lifelike companion.

Thus, it is an object of the present invention to provide an improved portable mannequin.

It is a further object of the present invention to provide a portable mannequin which may be used as a security companion.

Yet another object of the invention is to provide a portable mannequin which may be easily assembled or collapsed into a compact configuration and retained within a portable carrying case, bag or other enclosure.

Another object of the invention is to provide a lightweight and easily transportable portable mannequin.

Yet another object of the invention is to provide a portable mannequin which has an easily utilized, mechanical erection mechanism.

Still another object of the present invention is to provide a portable mannequin which is easy to use, easy to assemble and disassemble, inexpensive, rugged, and lifelike in appearance.

A further object of the present invention is to provide a portable mannequin which may serve as an apparent companion or as a sole occupant in a house, automobile or the like in order to create the appearance of a human presence.

Another object of the invention is to provide a portable, erectable mannequin device which may be arranged to position the erected mannequin device in a sitting or a standing position.

These and other objects, advantages and features will be set forth in the detailed description which follows.

BRIEF DESCRIPTION OF THE DRAWING

In the detailed description which follows, reference will be made to the drawing comprised of the following figures:

FIG. 1 is a perspective view of the portable mannequin of the invention as incorporated in its associated carrying case and wherein the mannequin is in the dressed and fully assembled form FIG. 2 is a perspective view similar to FIG. 1 illustrating the use of the assembled mannequin as it would appear in an automobile seat as a security companion;

FIG. 3 is a perspective view of the portable mannequin of the present invention collapsed into its associated carrying case;

FIG. 12 is a cutaway side view of the carrying case disclosing the manner in which leg forms are stored within the case;

FIG. 13 is a further side view of the carrying case wherein the mannequin has been fully folded and collapsed within the case;

FIG. 14 is a perspective view disclosing the manner in which the carrying case is assembled about the collapsed mannequin;

FIG. 15 is a side perspective view of the carrying case wherein the mannequin has been fully collapsed and enclosed therein;

DESCRIPTION OF THE PREFERRED EMBODIMENT

Figure 4:
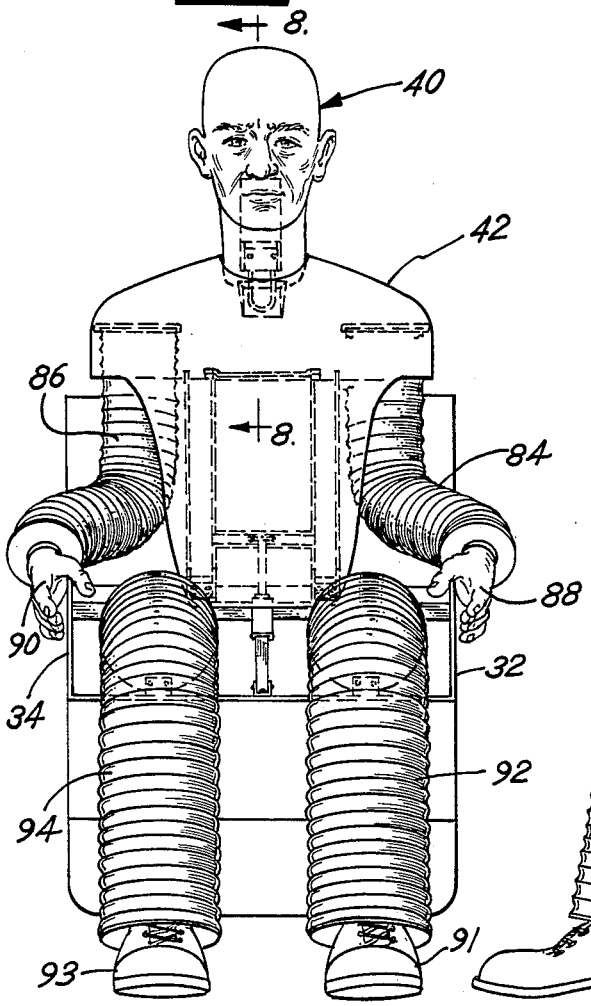
FIG. 4 is a front elevation of the mechanical construction comprising the portable mannequin of the construction

FIGS. 1 and 2 provide an overall view of the portable mannequin of the present invention in its open or uncollapsed condition. FIGS. 3 and 15 depict the portable mannequin of the present invention in its folded, collapsed or packaged condition. FIGS. 4–14 depict the actual construction of a preferred embodiment of the invention. However, the invention is not limited by the specific embodiment depicted and alternative constructions or forms of the mannequin structure as well as the carrying case for the mannequin structure are within the scope of the invention.

Referring therefore to FIG. 1, the portable mannequin of the present invention includes a carrying case generally shown at 10 which, when open as shown in FIGS. 1 and 2, permits a mannequin form generally shown at 12 to be erected so as to fit within the carrying case 10. The carrying case 10 thus serves as a chair or seat in appearance for the mannequin form 12. The case 10 may be positioned on an automobile seat 14, for example, in FIG. 2 to support the mannequin form 12 so as to appear as though a person is actually seated in that automobile seat 14. In practice, the mannequin form 12 can be placed on the passenger side in an automobile and appear as though it is a person accompanying a driver.

Alternatively, the mannequin form 12 may be positioned in a seat or chair within a home, for example, again to appear as though there is a companion for the person in that home. The mannequin form 12 may be fitted with articles of clothing such as jacket 16 as shown in FIG. 1 and trousers 18 as shown in FIG. 1 in order to personalize the appearance of the mannequin. Other articles of clothing and accessories such as hats, glasses, mustache, beard, etc. may be used on the mannequin form 12 to further personalize the mannequin form 12 for the particular situation involved.

As depicted in FIGS. 3 and 15, the carrying case 10 is assembled to incorporate the mannequin form 12 for easy transport. The mannequin form 12 thus is quite lightweight and has the capability of being collapsed and stored within the carrying case 10. The carrying case 10 preferably includes a carrying strap 95 attached to sides of the carrying case 10 as well as a handle 22 again attached to a side of the carrying case 10 for purposes of carrying or transport as depicted in FIGS. 3 and 15. The size or dimension of the carrying case 10 when in the form depicted in FIG. 3 is similar to that of a small suitcase or garment bag. When not in use, the carrying case 10 can easily be stored in the trunk of an automobile or in a closet, for example. Because of its light weight, it can be easily transported without any suggestion that the case 10 actually includes a mannequin form 12.

Referring now to FIGS. 4–14, there is illustrated in greater detail the specific construction of the mannequin form 12 and carrying case 10. The carrying case 10 includes a top 24 which is attached by a hinge 26 to the back side 28 of the case 10. The back side 28 is affixed to the bottom 30 which has substantially the same size and shape as the top 24. The case 10 also includes opposite sides 32 and 34 which extend upward from the bottom 30 and in combination with the back side 28 form a chair for the erect mannequin form 12 and a compartment or enclosure for the collapsed mannequin form. A top side 36 of case 10, to which the handle 22 is affixed, is attached by a hinge 38 to the bottom 30. The top side 36 connects with a flap 39 which fits over the top 24 as depicted in FIG. 15 as well as in FIG. 14.

The dimensions of the top and bottom 24 and 30 as well as the sides 28, 32, 34 and 36 are such that a generally rectangular parallelepiped case 10 is formed. The mannequin form 12, when collapsed, can easily fit therein and, in particular, into the enclosure formed by the component parts of the carrying case 10. Depending upon the size and shape of the mannequin form 12, therefore, the size and shape of the carrying case 10 may be accordingly varied.

Further, the various parts of the carrying case 10 may be made of a rigid, semi-rigid, flexible material or in a bag-like form (e.g. a barrel bag) in order to define an enclosure for the mannequin form 12. Further, the component parts of the carrying case 10 may be made from various materials such as a molded plastic, for example, in order to define the component parts of the carrying case 10. A wide range of materials and configurations for forming the carrying case are possible including that of a flexible bag from which the mannequin structure may be entirely removed.

Within the carrying case 10, the mannequin form 12 is comprised of a head form 40 which is hinged to a torso form 42. The torso form 42 is, in turn, hinged to the side 28 or more particularly to a bracket 44 which is attached to the back side 28 of the case.

Referring first then to the head form 40, the head form 40 includes a front or face portion 46 which is generally rigid and defines the shape of a particular face as desired. The face portion 46 may include eyes that are separate and movable and likewise may include a mouth configuration which has movable parts as well as an audio transmitter or sound generator. For purposes of the disclosure, the face portion 46 is fabricated from a generally rigid molded plastic in the form of a human face. However, a wide range of materials can be used for the body component parts.

The head form 40 also includes a cranial portion 48 which is affixed as a continuation of the face portion 46 and which is formed from a flexible material but form retaining material. That is, the cranial portion 48 is collapsible between the position shown in FIG. 8 and the position shown in FIG. 10. A circumferential, support ridge extends across the back side of the cranial portion 48 and operates to facilitate maintenance of the cranial portion 48 in the form shown in FIG. 8 or in the alternative form shown in FIG. 10. The ridge 50 also serves as an anchor with respect to a hairpiece, hat or other attachment to the cranial portion 48. The cranial portion 48 is thus susceptible to movement between the positions shown in FIGS. 8 and 10 which are respectively the assembled and the collapsed position of the head form 40.

Figure 6:
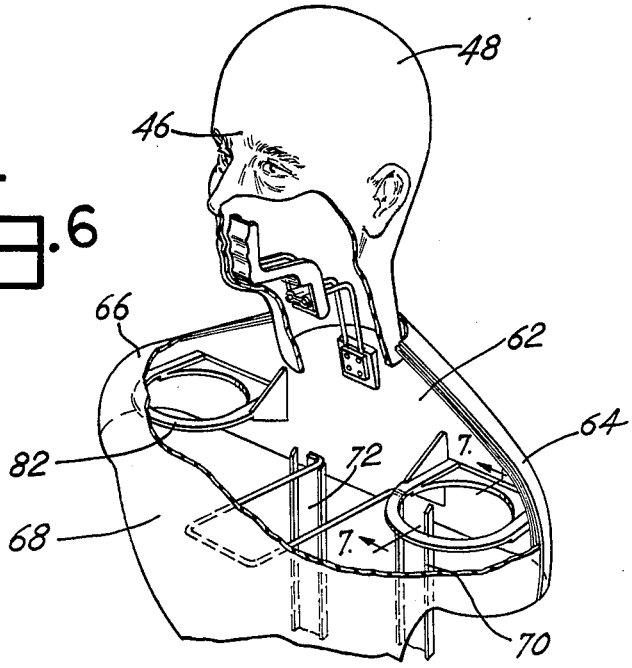
FIG. 6 is a partially cutaway perspective view of the shoulder portion and head form of the mannequin.
Figure 7:
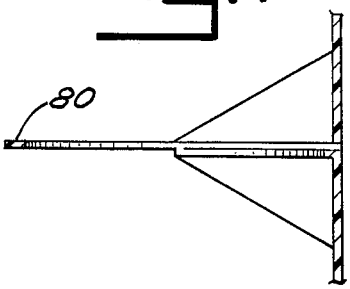
FIG. 7 is a side cross sectional view of the arm bracket incorporated in the shoulder portion of the mannequin taken along the line 7—7 in FIG. 6.
Figure 8:
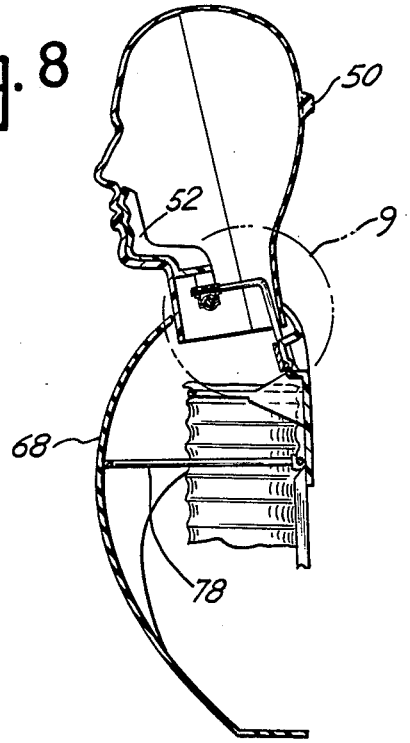
FIG. 8 is a side cross sectional view of the head form and shoulder portion of the mannequin taken along the line 8—8 in FIG. 4.
Figure 9:
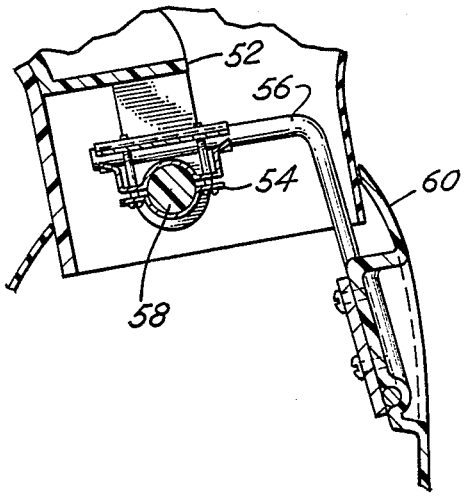
FIG. 9 is an enlarged cross sectional view of the connection between the head form and shoulder portion depicted in FIG. 8.
Figure 10:
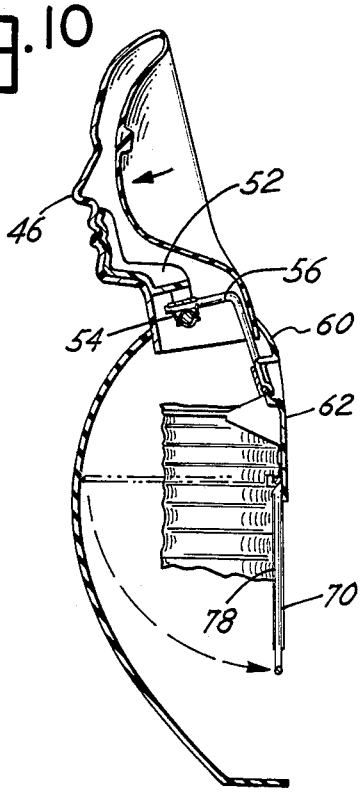
FIG. 10 is a side cross sectional view similar to FIG. 8 wherein the head form has been deformed to a collapsed position.

The head form 40 is also supported by a face portion bracket 52 which attaches to the back side of the face portion 46 as shown in FIGS. 6, 8 and 10. The face portion bracket 52 supports a rod 58. Rod 58 connects to clamp 54 which is mounted on a bracket 56 as shown in FIG. 9. The rod 58 thus may pivot or swing about its axis held by clamp 54. Clamp 54 is attached to the bracket 56 for movement of the face form 40 between the position shown in FIG. 10 and the position shown in FIG. 11.

Figure 5:
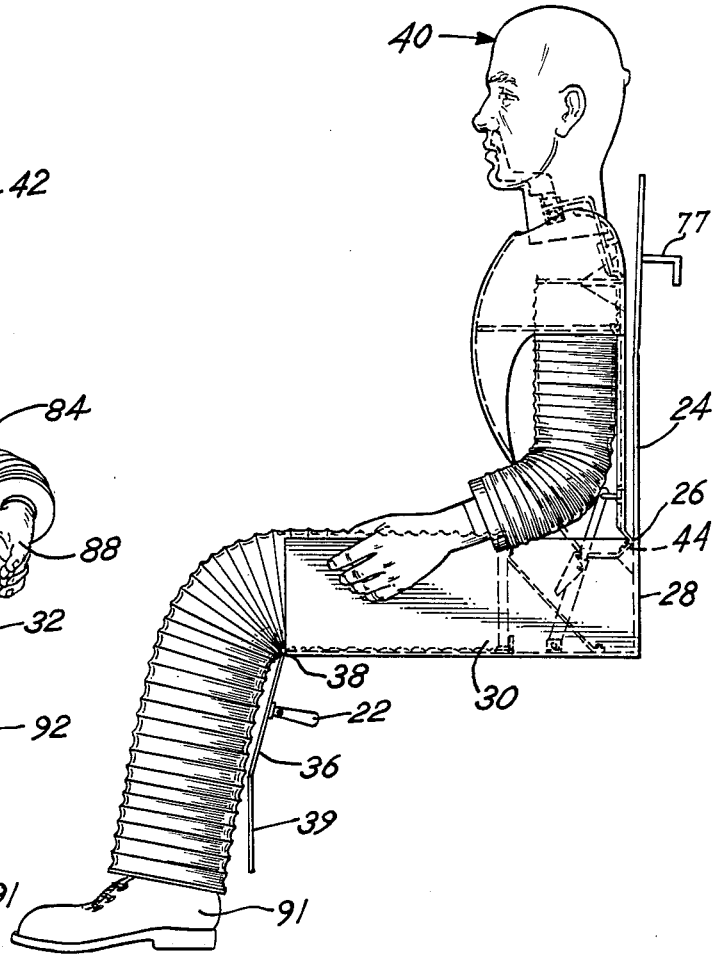
FIG. 5 is a side elevation of the mannequin of FIG. 4.
Figure 11:
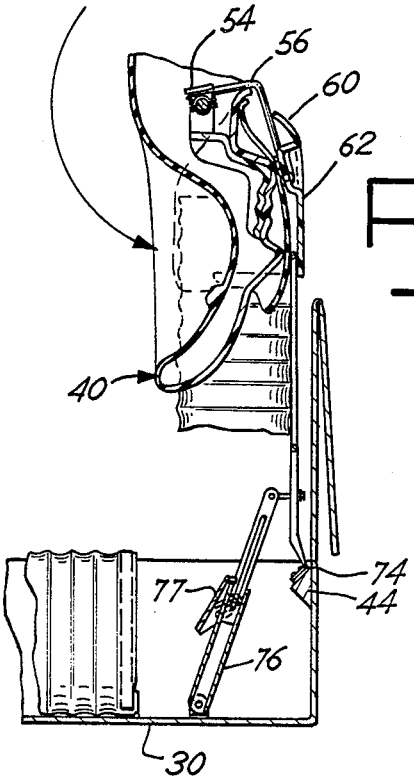
FIG. 11 is a side cross sectional view similar to FIGS. 8 and 10 wherein the head form is collapsed and pivoted into the torso form of the mannequin.

The bracket 56 is supported on a shoulder form 60 and more particularly on a rigid back portion 62. The shoulder form 60 thus includes a rigid back portion 62, rigid shoulder portions 64 and 66, as well as a flexible chest portion 68 which extends downwardly from the shoulder form 60 to the waist of the mannequin. Parallel support bars 70 and 72 (in FIG. 6) connect from the rigid back portion 62 to a hinge mechanism 74 as shown in FIG. 11 which is connected to the support bracket 44. A locking brace member 76 connects between the bottom 30 and the bracket members 70 and 72 to support the bracket members 70 and 72 in the upright or vertical position as depicted in FIG. 5 and FIG. 11.

A pivoting U-shaped bracket 78 as shown in FIG. 10 is fastened to the rigid back portion 62 and movable between the position shown in FIG. 10, which is a retracted position, and an extended position, which is shown in FIG. 8. Bracket 78 cooperates with the flexible chest portion 68 and thus defines the chest of the torso form 42. When collapsing the mannequin, the bracket 78 is retracted to the position shown in FIG. 10 so that the face 46 may fit against the chest portion 68 and flex that portion inwardly so as to collapse the torso form 42 of the mannequin.

Arm support brackets 80 and 82 ar attached to the rigid back portion 62 on opposite sides thereof beneath the shoulders 64 and 66. The brackets 80 and 82 each cooperate with flexible cylindrical plastic tubing having reinforcing wire therethrough to define arm forms 84 and 86 as shown in FIG. 4. The arm forms 84 and 86 respectively are connected with hand forms 88 and 90, respectively. Note that the hand forms 88 and 90 are arranged in such a fashion that the thumbs thereof fit over the sides 32 and 34, respectively, to facilitate the appearance of a person in a sitting position when the mannequin is erect.

Positioned within the enclosure defined by the case 10, at each side thereof, on the opposite sides of the support brace 76, are wire reinforced plastic tubes 92 and 94 as depicted in FIG. 4. The plastic tubes 92 and 94 are expandable from a compacted position such as shown in FIG. 13 to the extended position such as shown in FIGS. 4 and 5 so as to define leg forms. Shoe forms 91, 93 may optionally be attached to the respective ends of the leg forms 92, 94. Preferably the shoe forms 91, 93 are collapsible rubber forms.

All of the forms so described when assembled as in FIG. 4 or FIG. 5, are in an erect, sitting and extended position. They may be dressed in clothing as previously described to replicate a sitting human form. Conversely, when the mannequin form is to be collapsed or folded into the case 10, the head form 40 is first collapsed and folded about rod 58 as depicted in FIGS. 8–11. The brace 76 is released by release of the brace holder 77. The arms 84 and 86 are folded as are the support bars 70 and 72. Prior thereto the leg forms 92 and 94 are folded into position as depicted in FIG. 12. Ultimately the entire mannequin form 12 is folded into the case 10 as shown in FIG. 13.

Thereafter the top 24 is folded over the compacted mannequin form 12 as depicted in FIG. 14 and the top side 36 is then folded to close the case 10. The flap 39 which includes a strip of fastening material on its inside cooperates with the top 30 to close the case 10.

Alternatively, the brace 76 may be elongated or detached to align the top 24 and bottom 30 in coplanar array. The mannequin can then be supported in full erect position by a bracket 77 which fits over a chair or other support. Alternatively, the strap 95 in FIG. 3 can be looped over a support at the back of the mannequin to support the mannequin in an erect position.

Figure 16:
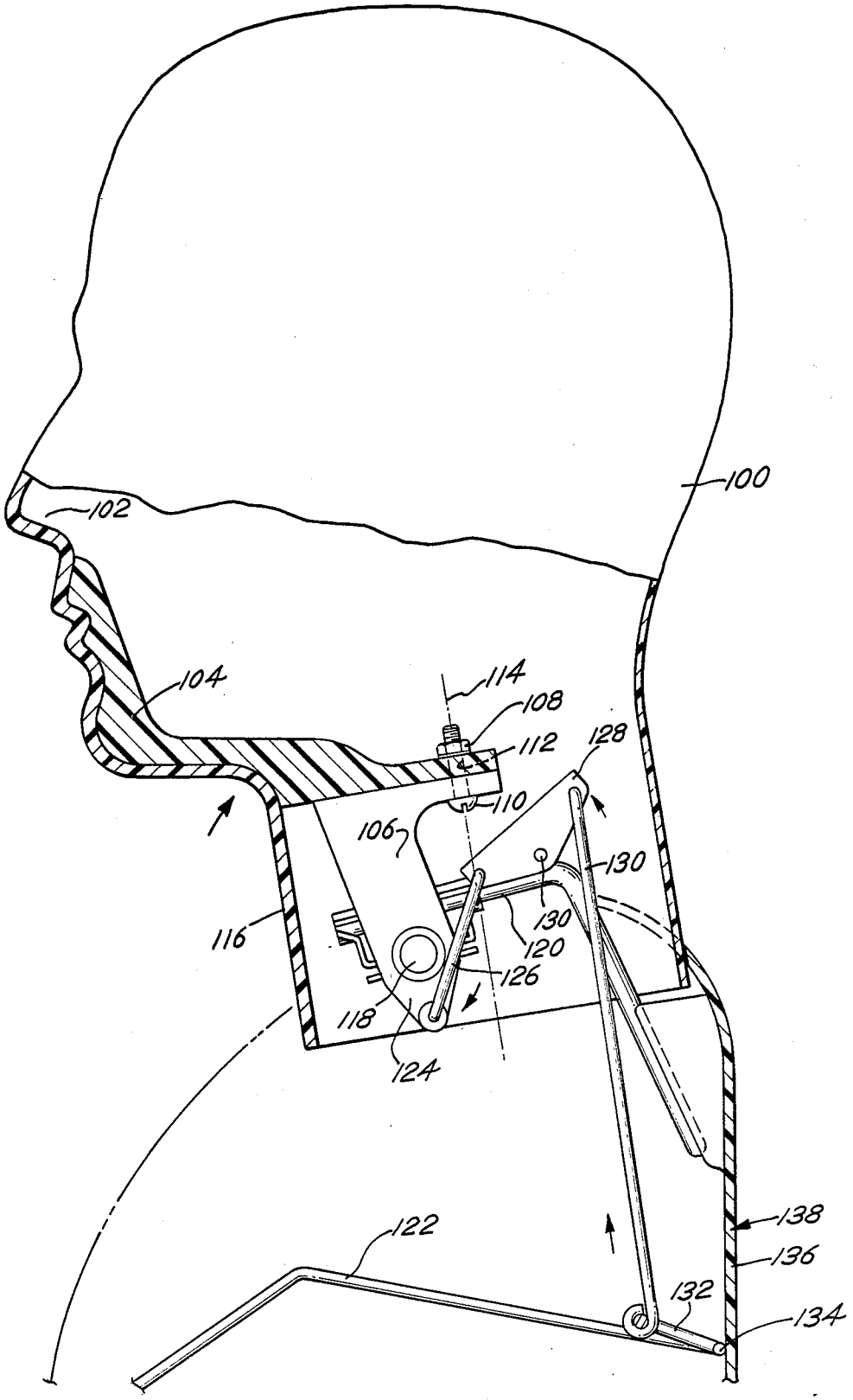
FIG. 16 is a side cross sectional view similar to FIG. 8 depicting an alternative mechanical mounting construction for the head form of the mannequin in the erect position.
Figure 17:
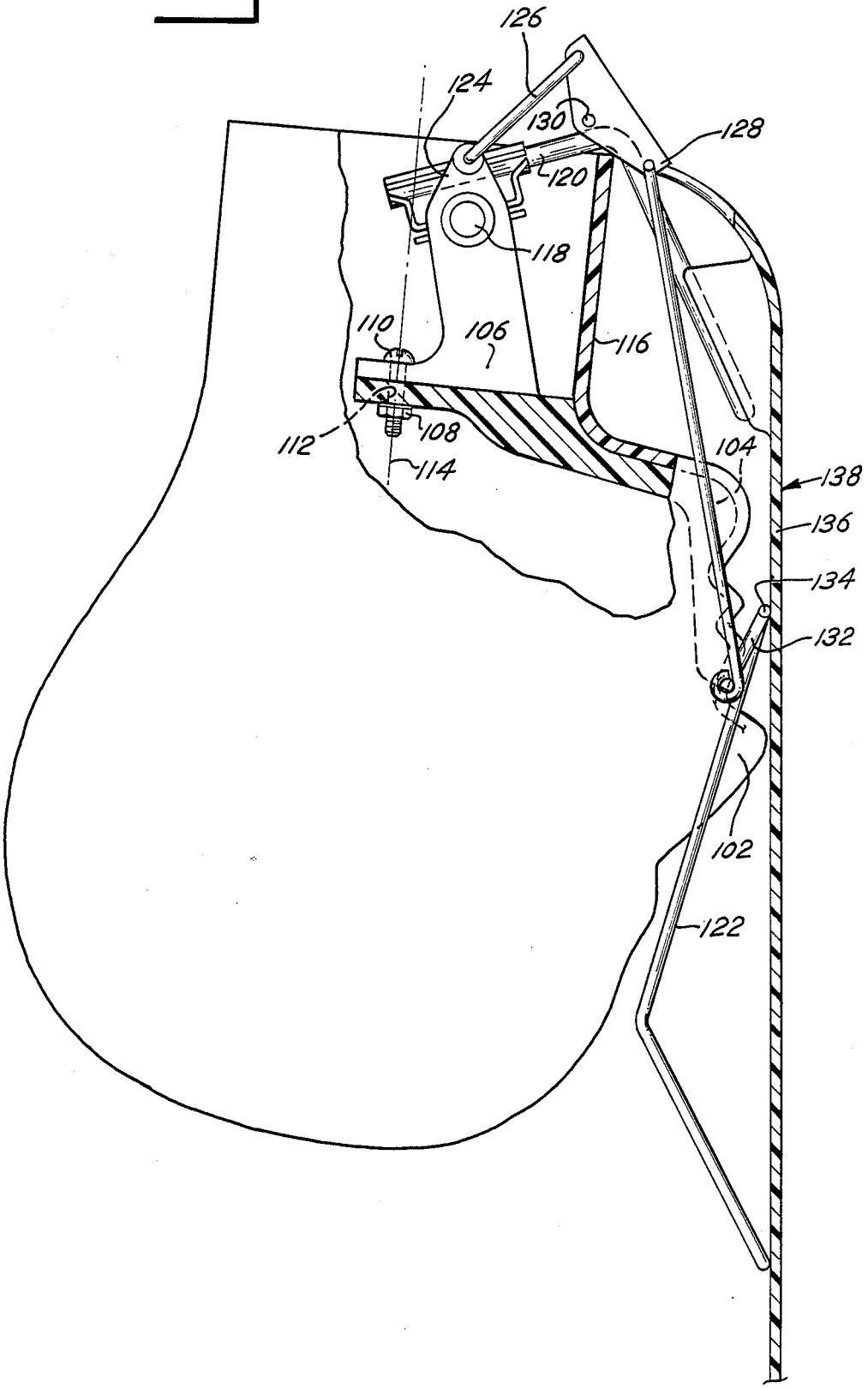
FIG. 17 is a side cross sectional view of the alternative construction of FIG. 16 in the partially collapsed position.

FIGS. 16 and 17 illustrate an alternative mechanism for support of a head form 100. The head form 100 includes a base portion 102 which is generally rigid and is supported by face form bracket 104. The bracket 104 cooperates with and is pivotally mounted on a head support bracket 106 by means of a nut and bolt 108 and 110 which connect through a passage 112. The bolt 110 defines an axis of rotation or a pivotal axis 114 for the head form 100. The head form 100 includes a flexible skirt or neck portion 116 which covers the mechanism including the bracket 106.

The bracket 106 is pivotally mounted on a shaft 118 which, in turn, is affixed to a bracket member 120. Specifically, the shaft or rod 118 extends from bracket 106 and cooperates with a clamp 119 supported by bracket member 120. This construction is similar to that associated with FIG. 8 and pivoting about the shaft 118 between the positions of FIG. 16 and FIG. 17 result in the head moving from the erect position of FIG. 16 to the collapsed position of FIG. 17.

The embodiment of FIGS. 16 and 17, in addition to including the feature of having the head form 100 being pivotal, also provides for a linkage between a chest cavity brace 122 and the bracket 106 whereby the brace 122 is automatically lowered or raised depending upon the position of the head form. Thus, the bracket 106 includes an extension or wing 124 which cooperates with a link 126 connected to a crank 128. The crank 128 is pivotally mounted on pin 130. One end of the crank 128 connects with the link 126. The other end of the crank 128 connects with a second link 130 which, in turn, is attached pivotally to an arm 132 associated with a brace 122. Brace 122 thus pivots about a rod or shaft 134 which is generally transverse to the brace 122 and is affixed to the rigid shoulder portion 136 of the torso form 138 of the embodiment shown in FIGS. 16 and 17.

Pivoting of the head form 100 about the shaft 118 will thus result in movement of the linkage so described from the position shown in FIG. 16 to the position shown in FIG. 17. The brace 122 thus automatically lowers within the chest cavity permitting easy folding of the head form and torso form automatically relative to the construction such as shown in FIG. 8.

The description of the head form 40, torso form 42, arm forms 84, 86, leg forms 90, 92, and the like are merely illustrative of the type of collapsible mannequin which may be used in cooperation with a case 10. Thus, alternative mechanical arrangements as well as inflatable arrangements may be utilized to define the mannequin form 12.

Alternative constructions for the torso form and for the mechanism for causing the torso form to be supported in an erect position may include a linkage comprising a series of crossed arms operative in a scissor-like fashion in order to raise and lower the shoulder form and head form. Alternatively, the shoulder form and head form may be supported by a pair of parallel links which are articulated and connect between the base and the shoulders. Yet another alternative is to provide for a torso form and head form which constitutes a balloon that is inflatable. Yet another alternative is to provide for a mechanism similar to the mechanism for supporting an open umbrella to support the head form as well as the shoulder form.

The various component parts may also be mechanically movable to simulate movement of a person. Thus, the arms may move to and fro. The legs may swing, etc. to replicate human movement and enhance the lifelike character of the mannequin.

The collapsible bag may, as previously described, have many alternative constructions. The mannequin form, for example, may be entirely removable from the bag and thus detached from the bag. The bag may be made of a totally flexible material requiring that the mannequin form be self-sustaining without reliance upon the rigidity of any component parts of the bag or carrying case. As another alternative, the mannequin can assume an erect standing position. Numerous alternative combinations are possible.

The invention is therefore to be limited only by the following claims and their equivalents.

What is claimed is:

1. A portable mannequin comprising in combination:

a carrying case having a top, a bottom, and sides separating the top and bottom to define an enclosure, the top hinged to a side and pivotable to expose the interior of the enclosure; and collapsible mannequin form within the case including a torso form and an attached head form on the torso form, said torso form supported by attachment to the case, said head form supported by attachment to the torso form; the head form and torso form both being foldable into the enclosure defined by the case and expandable from the case to replicate an upright body form supported by the case, the body form extending generally vertically, said torso form comprised of a shoulder form, said torso form also including bracket means pivotally attached at one end to the case and at its opposite end to the shoulder form, said shoulder form having a flexible chest portion, a generally rigid shoulder portion and a generally rigid back portion.

2. The mannequin of claim 1 wherein the head form is pivotally attached to the torso form.

3. The mannequin of claim 1 wherein the case is generally a rectangular parallelepiped.

4. The mannequin of claim 1 wherein the case is generally a rectangular parallelepiped with one pair of opposite sides fixed to the bottom and one remaining side also fixed to the bottom with the top hinged to said one remaining side, said torso form being attached to the inside of the case.

5. The mannequin of claim 1 including independent leg and feet forms mounted on the inside of the case and foldable from the case when the case is open.

6. The mannequin of claim 1 including collapsible arm forms attached to the shoulder form, each arm form terminating with a hand form.

7. The mannequin of claim 1 wherein the head form includes a generally rigid face form, a flexible and hollow cranial form attached to the face form and foldable toward the face form.

8. The mannequin of claim 1 including apparel on the mannequin.

9. The mannequin of claim 1 wherein a pivotable support bar extends from the back portion for defining the chest portion when the mannequin is erected, said support bar being retracted from engaging the chest portion when the mannequin is folded into the case.

10. The mannequin of claim 9 including linkage means between the pivotal support bar and the head form for automatically lowering the pivotal support bar whenever the head form is folded into the case.

11. The mannequin of claim 1 wherein the shoulder form includes arm support brackets, and wherein a foldable arm form is attached to each bracket.

12. The mannequin of claim 1 wherein the rigid shoulder portion includes a projecting support member rigidly connected at one end to the shoulder portion and pivotally connected at its opposite end to the head form whereby the head form and torso form are foldable into a compact assembly within the case enclosure.

13. The mannequin of claim 1 wherein the case includes means for fastening the case top, bottom and sides together to form an enclosure for retaining the mannequin form components.

14. The mannequin of claim 5 wherein the independent leg forms include foot forms collapsibly attached to the leg forms.

15. The mannequin of claim 1 wherein the head form is pivotally attached to the torso form for pivoting about a generally vertical axis when the forms are in the erect position.

16. The mannequin of claim 1 wherein the head form includes means for pivoting the head form about a generally horizontal axis toward and away from the torso form.

17. The mannequin of claim 1 wherein the bottom of the carrying case is at a substantially right angle to the top in the erect position with the body form extending upward from the bottom and supported by the top.

* * * * *